US012560321B2

(12) United States Patent
Spencer et al.

(10) Patent No.: US 12,560,321 B2
(45) Date of Patent: Feb. 24, 2026

(54) MATERIALS RECYCLING APPARATUS

(71) Applicant: Manik Ventures Limited, Evesham (GB)

(72) Inventors: Nik Spencer, Abbots Morton (GB); Hussam Jouhara, Manchester (GB)

(73) Assignee: Manik Ventures Limited, Evesham (GB)

( * ) Notice: Subject to any disclaimer, the term of this patent is extended or adjusted under 35 U.S.C. 154(b) by 600 days.

(21) Appl. No.: 16/616,331

(22) PCT Filed: May 23, 2018

(86) PCT No.: PCT/GB2018/051400
§ 371 (c)(1),
(2) Date: Nov. 22, 2019

(87) PCT Pub. No.: WO2018/215767
PCT Pub. Date: Nov. 29, 2018

(65) Prior Publication Data

US 2020/0158334 A1 May 21, 2020

(30) Foreign Application Priority Data

May 26, 2017 (GB) ..... 1708501

(51) Int. Cl.
*F23G 5/027* (2006.01)
*F23G 5/46* (2006.01)
(Continued)

(52) U.S. Cl.
CPC ..... *F23G 5/027* (2013.01); *F23G 5/46* (2013.01); *F23G 5/16* (2013.01);
(Continued)

(58) Field of Classification Search
None
See application file for complete search history.

(56) References Cited

U.S. PATENT DOCUMENTS 3,669,041 A * 6/1972 Schworer ..... F23G 5/12 110/193
4,154,567 A * 5/1979 Dahmen ..... F23G 7/065 422/182
(Continued)

FOREIGN PATENT DOCUMENTS

CN 1483963 A 3/2004
JP H0849821 A 2/1996
(Continued)

OTHER PUBLICATIONS

International Search Report and Written Opinion of the International Search Authority dated Nov. 10, 2018, for corresponding International Application PCT/GB2018/051400, filed May 23, 2018.
(Continued)

*Primary Examiner* — Jason Lau
(74) *Attorney, Agent, or Firm* — Westman, Champlin & Koehler, P.A.; Z. Peter Sawicki; Amanda M. Prose

(57) ABSTRACT

Materials recycling processes that include a combustion stage can operate very efficiently, but can produce exhaust gases that are high in carbon monoxide and the like. We describe a treatment unit which comprises a chamber for receiving the material, a heat source for (preferably) heat-treating the material and for initiating combustion, and a gas outlet from the chamber, which allows the gas that is exhausted via the outlet to be supplied to the air inlet of an associated boiler unit, with the air inlet and a separate fuel inlet feeding a burner for combusting fuel from the fuel inlet in air from the air inlet in order to heat a transfer fluid. In this way, the unburnt elements of the gas expelled from the chamber are included in the combustion process of the boiler unit and fully combusted. A corresponding method is also disclosed.

4 Claims, 1 Drawing Sheet

(51) Int. Cl.
*F23G 5/16* (2006.01)
*F24D 3/08* (2006.01)

(52) U.S. Cl.
CPC .. *F23G 2201/304* (2013.01); *F23G 2206/203* (2013.01); *F24D 3/08* (2013.01)

(56) References Cited

U.S. PATENT DOCUMENTS 4,172,431 A * 10/1979 Tatem ..... C10B 47/44 110/229
4,541,345 A 9/1985 Grumpelt et al.
2004/0025763 A1* 2/2004 Kaneko ..... F23G 5/16 110/346
2008/0282946 A1* 11/2008 Morandi ..... F23G 5/10 110/342
2009/0084292 A1* 4/2009 Cole ..... F23M 9/06 110/229
2011/0036014 A1* 2/2011 Tsangaris ..... C10J 3/482 48/62 R
2011/0311423 A1* 12/2011 Clarke ..... B01D 53/8696 422/108
2012/0012039 A1* 1/2012 Palmas ..... C10B 53/02 110/259
2014/0166465 A1* 6/2014 Varma ..... C10B 1/10 201/37
2015/0166911 A1* 6/2015 Reed ..... F23G 7/12 48/113
2015/0267916 A1* 9/2015 Wen ..... F23J 1/02 110/234
2016/0053182 A1* 2/2016 Ericsson ..... C10L 9/083 201/20
2016/0238241 A1* 8/2016 Rousseau ..... F23D 14/22
2016/0326440 A1 11/2016 Spencer et al.
2019/0119588 A1* 4/2019 O'Grady ..... C10K 3/008

FOREIGN PATENT DOCUMENTS

JP 2005326042 A 11/2005
WO 2009047392 A1 4/2009
WO 2015104400 A1 7/2015

OTHER PUBLICATIONS

European Intellectual Property Office Search Report dated Nov. 28, 2017, for corresponding European Patent Application No. GB1708501.0, filed May 26, 2017.

* cited by examiner

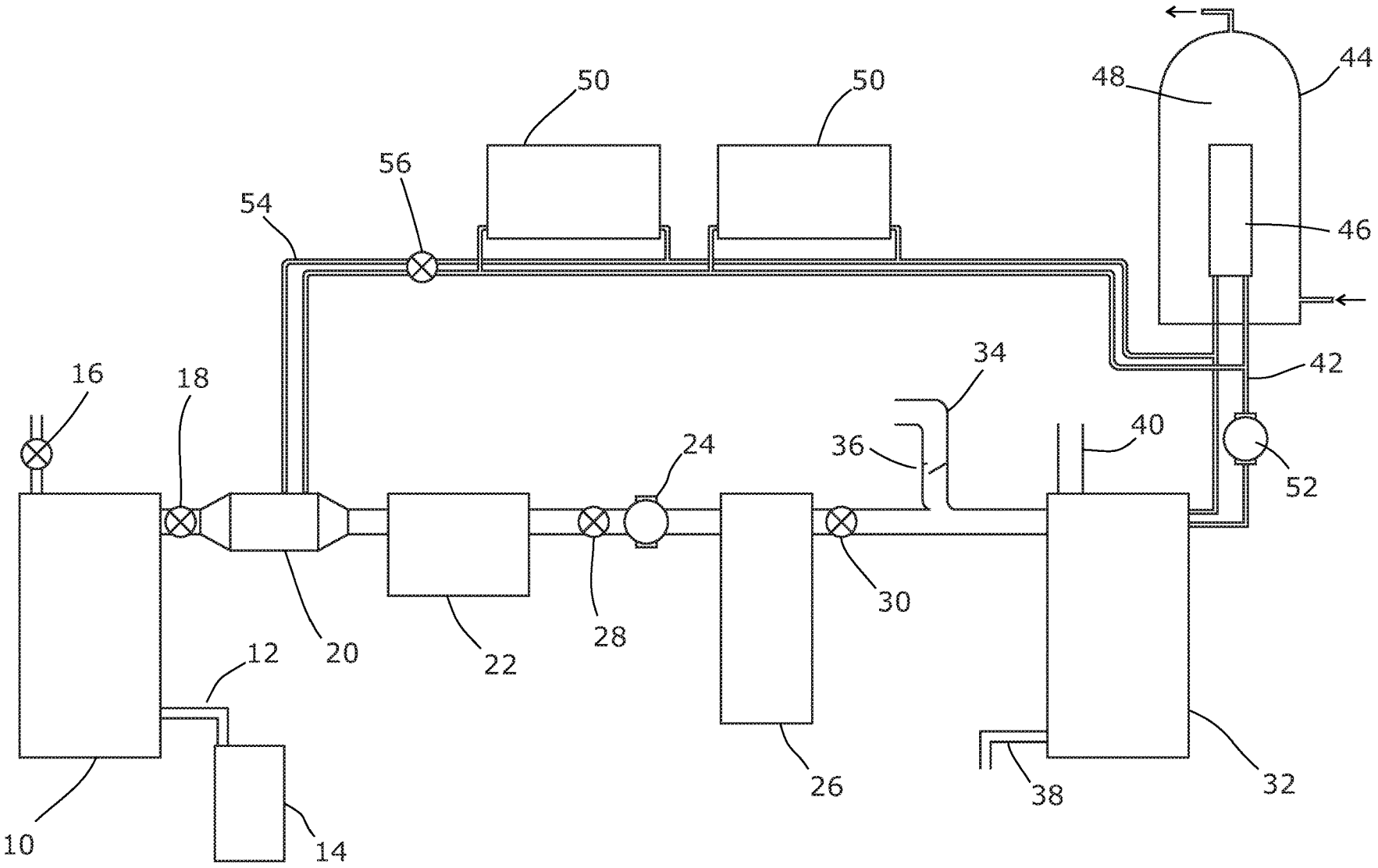
44
46
42
52
32
48
40
38
34
36
30
50
26
24
28
50
22
56
20
14
54
12
18
16
10

MATERIALS RECYCLING APPARATUS

CROSS-REFERENCE TO RELATED APPLICATION

This application is the U.S. national phase of PCT Application No. PCT/GB2018/051400 filed on May 23, 2018, and published as WO2018/215767 on Nov. 29, 2018, which claims priority and benefits of GB Patent Application Serial No. 1708501.0 filed May 26, 2017, the entire content of which is incorporated herein by reference.

FIELD OF THE INVENTION

The present invention relates to apparatus for recycling materials.

BACKGROUND ART

Our previous applications WO2015/104400 and WO2017/137716 proposed a new approach to the recycling of materials that might otherwise be disposed of, such as domestic and light commercial refuse. Instead of deploying large fleets of refuse collection vehicles to transport the refuse to central processing plants, we proposed small thermal treatment units that can be located in the premises concerned, to process the resources and release oils, syngas and heat that can be used to heat those premises or nearby premises.

Our patent applications set out this approach to recycling of resources, and give examples of suitable apparatus for doing so based principally on a combination of pyrolysis and combustion. In this process, the resources are first pyrolysed to release syngas and oils which are collected and retained as fuel for a heating system. Air is then introduced into the chamber to allow combustion of the char, i.e. the remaining material, releasing heat which can be captured via a heat exchanger and deployed to heat the premises. This leaves a residue of non-combustible materials (mainly metallic) which can be recycled, and a sterile ash which can be flushed away.

SUMMARY OF THE INVENTION

We have found that whilst this process recycles the resources very efficiently, the exhaust gases produced during the combustion stage are high in undesirable components such as carbon monoxide and volatile elements with a disagreeable odour. Carbon monoxide levels of around 300-400 ppm have been observed, for example.

We therefore propose that the treatment unit, which as a minimum generally comprises a chamber for receiving the resource material, a heat source for heat-treating the material and/or for initiating combustion of the material, and a gas outlet from the chamber, should allow the gas that is exhausted via the outlet after combustion to be supplied to the burner of an associated boiler unit (either directly, or via the air inlet, or via the fuel inlet) the boiler being one that employs a burner for combusting fuel from the fuel inlet in air from the air inlet in order to heat a fluid. In this way, the unburnt elements of the gas expelled from the chamber are included in the combustion process of the boiler unit and fully combusted. This is distinct from the pyrolysis products resulting from heat-treatment of the material; as our previous application WO2015/104400 describes, these can be extracted from the chamber in order to be used as fuel to heat or otherwise supply the premises in which the unit is installed. Alternatively, albeit less preferably, they can be left in the chamber to be combusted along with the char.

This can be done under the control of an apparatus adapted to control the treatment unit by:

i. activating the heat source thereby to initiate heat-treatment of the material in the chamber,
ii. optionally, extracting pyrolysis products from the chamber,
iii. venting the chamber thereby to admit oxygen and initiate combustion of remaining material in the chamber, and
iv. allowing exhaust of combustion products via the gas outlet to the boiler unit.

The boiler can be a normal domestic boiler such as is commonly installed in order to provide a supply of hot water for sanitary purposes and for premises heating. The usual design aim of such a boiler unit is to avoid incomplete combustion, as the associated exhaust products, principally carbon monoxide, are potentially very dangerous. Therefore, it is counter-intuitive to use oxygen-depleted air exhausted from a combustion chamber in which to burn the fuel for a boiler. Such an approach would be expected to reduce the efficiency of the boiler and increase the emission of undesirable exhaust constituents. However, our tests have found CO emissions from the boiler to be less than 40 ppm, which is below the legal limit of 150 ppm and hence acceptable, especially if vented to the atmosphere. Domestic boilers usually heat an intermediate or transfer fluid, usually water with suitable additives for corrosion resistance, etc, and this is circulated around a closed circuit. The circuit may be a heating circuit which includes one or more radiators in which the heat is transferred into the room, or it may include a heat exchanger located within a hot water storage tank. Multiple such circuits may be supplied by the boiler, each being activated as and when needed. Other designs of boiler are known and may be used, including designs which heat a sanitary water supply directly without use of an intermediate fluid.

The gas outlet can feed gas to the inlet of the boiler unit via a heat exchanger, and/or a scrubber to remove entrained particulates. If both are employed, then ideally the heat exchanger is first in sequence.

The pyrolysis products of the resources being recycled (i.e. the output of the treatment unit after heat treatment but prior to combustion) are preferably supplied to the fuel inlet of the boiler unit. These pyrolysis products are combustible and can thus reduce the demand for fuel from the boiler. They are preferably supplied to the fuel inlet via a storage vessel that collects the pyrolysis products and thus acts as a buffer. Likewise, the exhaust gases may also be stored temporarily, to allow for different operating schedules of the treatment unit and the boiler. The fuel inlet of the boiler may also be supplied by a separate source of combustible fuel (such as natural gas), separate from the treatment unit.

The invention also provides a corresponding method of treating materials, comprising the steps of heat-treating the material to yield pyrolysis products; admitting oxygen thereby to combust remaining material; exhausting at least the gaseous combustion products to a boiler unit, optionally admixing the combustion products with air; in the boiler unit, combusting a fuel in the gaseous combustion products, to heat a transfer fluid.

Many dwellings and premises already have a boiler unit, so it may be convenient to employ such a unit in the manner described above, and hence provide a treatment apparatus with an exhaust suitable for attachment to a typical boiler unit (etc). This also allows the treatment apparatus to be used together with one of a range of boiler units chosen to suit the dwelling or premises in question. Alternatively, the treatment apparatus and the boiler unit could be a single integrated unit.

BRIEF DESCRIPTION OF THE DRAWINGS

An embodiment of the present invention will now be described by way of example, with reference to the accompanying FIGURES in which the sole FIG. 1 schematically illustrates an arrangement according to the present invention.

DETAILED DESCRIPTION OF THE EMBODIMENTS

FIG. 1 shows a schematic layout of the overall system. Resource materials for recycling are loaded into a treatment chamber 10 where they are anaerobically heated to around 300-400° C. at which the material is pyrolised, yielding a range of products including mainly syngas and oils. Once pyrolysis is complete, these are removed via an outlet 12 and stored in a buffer 14. This leaves behind a residue which can be combusted by opening a valve 16 to allow a supply of air into the treatment chamber 10 while still at an elevated temperature. The hot exhaust gases from the combustion process can then be vented via an exhaust valve 18 to a heat exchanger 20 where the residual heat can be transferred to the transfer fluid of a conventional hot water system (explained more fully below). The cooled exhaust gases are then passed through a scrubber 22 to remove ash and other particulates; this is described and claimed in our copending application no. GB1706489.0 filed on 24 Apr. 2017 to which the reader is referred for a fuller description.

The exhaust gases are then pumped by pump 24 into a temporary store 26, and held there by closing valves 28, 30 on either side. When the boiler 32 is next activated, valve 30 can be opened to allow the exhaust gases to leave the temporary store 26 and be mixed with the air inlet 34 to the boiler 32. A non-return valve 36 should be provided in the air inlet 34 to prevent gases from the temporary store 26 from escaping to the atmosphere. In alternative arrangements, the exhaust gases can be mixed with a gaseous fuel such as LPG or natural gas supplied to the boiler via its gas inlet pipe, or they can be introduced directly into the burner of the boiler via a separate injection means. However, admixing the exhaust gases with the air supply is particularly convenient.

Storage of the exhaust gases in the temporary store is useful in that the combi boiler does not then need to be running continuously for the entire period during which the treatment chamber 10 is operating or combusting. This is possible (in which case the temporary store 26 could be omitted) but would not be efficient. In practice, the exhaust from the treatment chamber 10 produces about 0.03 cubic metres per second; when run through a small compressor 24 and put in a 20 litre capacity tank at (for example) 4 bar this allows approximately 81 litres of storage or 5 minutes of operation of the treatment chamber 10. A typical combi boiler takes 0.25 cubic metres per second, so will require only 30 seconds of running to consume the output of the previous 5 minutes. The boiler is therefore operating at a mark/space ratio of 1:10, significantly more efficient.

During this time, the output of the boiler can be used for space heating or for hot water generation and so use is made of the heat. Of course, the capacity and pressure of the temporary store 26 could be varied so that the exhaust gases are retained until such time as there is a heating or hot water demand and then released in their entirety.

The boiler 32 is a conventional domestic boiler, in this example. It receives a supply of natural gas from a gas inlet pipe 38 and burns this in air supplied via the air inlet 34. Exhaust gases are vented to the atmosphere via a flue 40. The heat that is generated is transferred into a transfer fluid, usually water containing corrosion inhibitors and the like. This circulates around a heating system via pipework 42; as is conventional this system include (i) a hot water tank 44 within which a heat exchanger 46 fed with the transfer fluid by the pipework 42 transfers the heat into clean water 48 that can then be used for sanitary purposes, and (ii) a plurality of radiators 50 which are fed with the transfer fluid and radiate heat from the fluid into the rooms in which they are located. A circulation pump 52 urges the transfer fluid around the pipework when needed, and ensures that the fluid does not dwell in the boiler where it might overheat and cavitate. Valves are usually provided so as to direct transfer fluid to the hot water tank 44 or the radiators, or both, as required, together with a control system to control activation of the boiler, the pump and the various valves. These are commonplace in the art and are therefore not illustrated and need not be described in detail.

The exact details of the plumbing of the heating system are not essential to the present invention. For example, other types of heating system exist, for example systems in which the boiler is activated on demand in order to heat sanitary water directly, systems that deal with heating only, or hot water only, or which have more or fewer elements. The specific layout illustrated in FIG. 1 is by way of an example only and may be varied as necessary as is well known in the plumbing art.

FIG. 1 also shows a link 54 from the pipework system 42 to the heat exchanger 20. A valve 56 between the link 54 and the pipework system 42 isolates the heat exchanger when necessary, and can be used to prevent heat generated by the boiler 32 (when active) from being dissipated in heating the heat exchanger 20. The valve 56 is opened when the exhaust gases from the treatment chamber 10 are being exhausted via the heat exchanger, to heat the transfer fluid. This can then be pumped around the pipework system 42 by the pump 52, either to heat the radiators 50 or to warm the water 48 in the hot water tank 44. Accordingly, efficient use is made of the heat employed to treat the material in the treatment chamber 10.

In an experimental arrangement in which exhaust gases from a treatment chamber 10 were fed (diluted) into the air inlet of a conventional domestic boiler, the change in the gas content was observed to be:

| Constituent | Chamber exhaust | Boiler Flue |
|---|---|---|
| $O_2$ (%) | 0.73 | 5.37 |
| CO (ppm) | 331 | 36.7 |
| NOx (ppm) | 50.4 | 14.1 |
| NO (ppm) | 48.0 | 13.4 |
| $CO_2$ (%) | 13.29 | 9.95 |

The exhaust gases were also observed to have lost a distinctive odour after passage through the boiler. Accordingly, the treatment of the exhaust gases in this manner converts an exhaust stream containing high pollutant levels into one that is considered safe to release into the atmosphere.

As mentioned above, syngas and oils are released from the material being processed during pyrolysis and are extracted and stored in vessel 14. These may be fed via a suitable pump and pipework (not shown) to the fuel inlet 38 of the boiler 32, further increasing the efficiency of the system by reducing the fuel demands of the system. The CO content of the gas provided to the boiler will also release some heat on combustion to $CO_2$, meaning that the overall system provides a safe and effective means for recycling resources, yielding a non-odorous output that is safe to vent, and incidentally reducing the fossil fuel demand of the boiler.

It will of course be understood that many variations may be made to the above-described embodiment without departing from the scope of the present invention.

The invention claimed is:

1. A method of treating material, comprising the steps of:

heat-treating the material anaerobically to yield pyrolysis products namely syngas and oils;

extracting the pyrolysis products to leave behind a char residue;

admitting oxygen thereby to combust the char residue in the absence of the pyrolysis products;

exhausting at least the gaseous combustion products from the combustion of the char residue to a boiler unit, optionally admixing these combustion products with air;

in the boiler unit, combusting a fuel in combination with the gaseous combustion products, to heat a transfer fluid.

2. A method according to claim 1 in which the gaseous combustion products are fed to the boiler unit via a heat exchanger.

3. A method according to claim 1 in which the gaseous combustion products are fed to the boiler unit via a scrubber to remove entrained particulates.

4. A method according to claim 1 in which the transfer fluid is water-based.

* * * * *